US010738557B2

(12) United States Patent
Donald et al.

(10) Patent No.: US 10,738,557 B2
(45) Date of Patent: Aug. 11, 2020

(54) METHOD AND APPARATUS FOR OIL AND GAS OPERATIONS

(71) Applicant: ENPRO SUBSEA LIMITED, Aberdeen (GB)

(72) Inventors: Ian Donald, Aberdeen (GB); John Reid, Aberdeen (GB)

(73) Assignee: Enpro Subsea Limited, Aberdeen (GB)

( * ) Notice: Subject to any disclaimer, the term of this patent is extended or adjusted under 35 U.S.C. 154(b) by 0 days.

(21) Appl. No.: 16/212,415

(22) Filed: Dec. 6, 2018

(65) Prior Publication Data

US 2019/0218881 A1 Jul. 18, 2019

Related U.S. Application Data

(63) Continuation of application No. 14/379,277, filed as application No. PCT/GB2013/050364 on Feb. 15, 2013, now Pat. No. 10,174,575.

(30) Foreign Application Priority Data

Feb. 15, 2012 (GB) ..... 1202581.3

(51) Int. Cl.

| | |
|---|---|
| ***E21B 33/076*** | (2006.01) |
| ***E21B 49/08*** | (2006.01) |
| ***E21B 33/035*** | (2006.01) |
| ***E21B 33/038*** | (2006.01) |
| ***E21B 34/04*** | (2006.01) |
| ***E21B 49/00*** | (2006.01) |

(52) U.S. Cl.
CPC ..... *E21B 33/076* (2013.01); *E21B 33/035* (2013.01); *E21B 33/038* (2013.01); *E21B 34/04* (2013.01); *E21B 49/001* (2013.01); *E21B 49/08* (2013.01)

(58) Field of Classification Search
CPC .... E21B 33/035; E21B 33/038; E21B 33/076; E21B 34/04; E21B 49/001; E21B 49/08
See application file for complete search history.

(56) References Cited

U.S. PATENT DOCUMENTS

| | | | | |
|---|---|---|---|---|
| 10,174,575 | B2 * | 1/2019 | Donald | E21B 33/076 |
| 2003/0145998 | A1 * | 8/2003 | Langford | B01D 17/0211 166/350 |
| 2005/0070150 | A1 * | 3/2005 | Williams | E21B 23/006 439/374 |
| 2005/0205262 | A1 * | 9/2005 | Reimert | E21B 33/035 166/348 |
| 2006/0108120 | A1 * | 5/2006 | Saucier | E21B 33/035 166/344 |

* cited by examiner

*Primary Examiner* — James G Sayre
(74) *Attorney, Agent, or Firm* — David B. Tingey; Bryant J. Keller; Kirton McConkie

(57) ABSTRACT

An apparatus and system for accessing a flow system (such as a subsea tree) in a subsea oil and gas production system, and method of use. The apparatus comprises a body defining a conduit therethrough and a first connector for connecting the body to the flow system. A second connector is configured for connecting the body to an intervention apparatus, such as an injection or sampling equipment. In use, the conduit provides an intervention path from the intervention apparatus to the flow system. Aspects of the invention relate to combined injection and sampling units, and have particular application to well scale squeeze operations.

27 Claims, 12 Drawing Sheets

METHOD AND APPARATUS FOR OIL AND GAS OPERATIONS

CROSS-REFERENCE TO RELATED APPLICATIONS

This is a Continuation Application of U.S. Utility patent application Ser. No. 14/379,277, filed Aug. 15, 2014, which is a National Stage Application of PCT/GB2013/050364, filed Feb. 15, 2013, which designates the United States and claims the priority of GB patent application GB1202581.3, filed on Feb. 15, 2012; the entire disclosures of which are incorporated herein by reference.

METHOD AND APPARATUS FOR OIL AND GAS OPERATIONS

The present invention relates to methods and apparatus for oil and gas operations, in particular to methods and apparatus for fluid intervention in oil and gas production or injection systems. The invention has particular application to subsea oil and gas operations, and aspects of the invention relate specifically to methods and apparatus for fluid intervention in subsea oil and gas production and injection infrastructure.

BACKGROUND TO THE INVENTION

In the field of oil and gas exploration and production, it is common to install an assembly of valves, spools and fittings on a wellhead for the control of fluid flow into or out of the well. A Christmas tree is a type of fluid manifold used in the oil and gas industry in surface well and subsea well configurations and have a wide range of functions, including chemical injection, well intervention, pressure relief and well monitoring. Christmas trees are also used to control the injection of water or other fluids into a wellbore to control production from the reservoir.

There are a number of reasons why it is desirable to access a flow system in an oil and gas production system. In the context of this specification, the term "fluid intervention" is used to encapsulate any method which accesses a flow line, manifold or tubing in an oil and gas production, injection or transportation system. This includes (but is not limited to) accessing a flow system for fluid sampling, fluid diversion, fluid recovery, fluid injection, fluid circulation, fluid measurement and/or fluid metering. This can be distinguished from full well intervention operations, which generally provide full (or near full) access to the wellbore. Full well intervention processes and applications are often technically complex, time-consuming and have a different cost profile to fluid intervention operations. It will be apparent from the following description that the present invention has application to full well intervention operations. However, it is an advantage of the invention that full well intervention may be avoided, and therefore preferred embodiments of the invention provide methods and apparatus for fluid intervention which do not require full well intervention processes.

International patent application numbers WO00/70185, WO2005/047646, and WO2005/083228 describe a number of configurations for accessing a hydrocarbon well via a choke body on a Christmas tree.

Although a choke body provides a convenient access point in some applications, the methods of WO00/70185, WO2005/047646, and WO2005/083228 do have a number of disadvantages. Firstly, a Christmas tree is a complex and carefully-designed piece of equipment. The choke performs an important function in production or injection processes, and its location on the Christmas tree is selected to be optimal for its intended operation. Where the choke is removed from the choke body, as proposed in the prior art, the choke must be repositioned elsewhere in the flow system to maintain its functionality. This compromises the original design of the Christmas tree, as it requires the choke to be located in a sub-optimal position.

Secondly, a choke body on a Christmas tree is typically not designed to support dynamic and/or static loads imparted by intervention equipment and processes. Typical loads on a choke body in normal use would be of the order of 0.5 to 1 tonnes, and the Christmas tree is engineered with this in mind. In comparison, a typical flow metering system as contemplated in the prior art may have a weight of the order of 2 to 3 tonnes, and the dynamic loads may be more than three times that value. Mounting a metering system (or other fluid intervention equipment) on the choke body therefore exposes that part of the Christmas tree to loads in excess of those that it is designed to withstand, creating a risk of damage to the structure. This problem may be exacerbated in deepwater applications, where even greater loads may be experienced due to thicker and/or stiffer components used in the subsea infrastructure.

In addition to the load restrictions identified above, positioning the flow intervention equipment on the choke body may limit the access available to large items of process equipment and/or access of divers or remotely operated vehicles (ROVs) to the process equipment or other parts of the tree.

Furthermore, modifying the Christmas tree so that the chokes are in non-standard positions is generally undesirable. It is preferable for divers and/or ROV operators to be completely familiar with the configuration of components on the Christmas tree, and deviations in the location of critical components are preferably avoided.

Another drawback of the prior art proposals is that not all Christmas trees have chokes integrated with the system; approaches which rely on Christmas tree choke body access to the flow system are not applicable to these types of tree.

It is amongst the objects of the invention to provide a method and apparatus for accessing a flow system in an oil and gas production system, which addresses one or more drawbacks or disadvantages of the prior art. In particular, it is amongst the objects of the invention to provide a method and apparatus for fluid intervention in an oil and gas production system, which addresses one or more drawbacks of the prior art. An object of the invention is to provide a flexible method and apparatus suitable for use with and/or retrofitting to industry standard or proprietary oil and gas production manifolds, including Christmas trees.

It is an aim of at least one aspect or embodiment of the invention to provide an apparatus which may be configured for use in both a subsea fluid injection operation and a production fluid sampling operation.

Further objects and aims of the invention will become apparent from the following description.

SUMMARY OF THE INVENTION

According to a first aspect of the invention there is provided an apparatus for accessing a flow system in a subsea oil and gas production system, the apparatus comprising:

a body defining a conduit therethrough;

a first connector for connecting the body to the flow system;

a second connector for connecting the body to an intervention apparatus;

wherein, in use, the conduit provides an intervention path from the intervention apparatus to the flow system.

The apparatus is preferably a fluid intervention apparatus, which may be a fluid intervention apparatus for fluid sampling, fluid diversion, fluid recovery, fluid injection, fluid circulation, fluid measurement and/or fluid metering.

Preferably, the apparatus is an access hub which is configured for connection to the flow system. The access hub may be configured to be connected to an external opening on the flow system. For example, the access hub may be configured to be connected to a flange of the flow system. The flow system may comprise a blind flange, removal of which provides a flange connection point for the access hub.

Where the flow system comprises a subsea Christmas tree, the external opening may be downstream of a wing valve of the Christmas tree.

The external opening may be a flowline connector, such as a flowline connector for a jumper flowline. The apparatus may comprise a third connector for connecting the apparatus to a downstream flowline such as a jumper flowline. Therefore the apparatus may be disposed between a flowline connector and a jumper flowline, and may provide a flow path from the flow system to the jumper flowline, and may also establish an access point to the flow system, via the conduit and the first connector.

A flowline connector for a jumper flowline is a preferred location for the connection of the access hub. This is because it is displaced from the Christmas tree sufficiently to reduce associated spatial access problems and provides a more robust load bearing location compared with locations on the Christmas tree itself (in particular the choke body). However, it is still relatively near to the tree and the parts of the flow system to which access is required for the intervention applications.

The apparatus may provide a further connector for connecting the body to an intervention apparatus, which may be axially displaced from the second connector (in the direction of the body). Therefore the apparatus may provide a pair of access points to the flow system, which may facilitate certain applications including those which require fluid circulation and/or sampling.

In one embodiment, the access hub is configured for connection to an external opening of a choke body, which may be on a side of the choke body. Preferably in this embodiment, the access hub is configured to be connected to the choke body without interfering with the position or function of the choke (i.e. the choke may remain in situ in the choke body).

Preferably, the access hub is configured to be connected to a flowline at a location displaced from a choke of the flow system. The access hub may be configured to be connected to the flow system at a location selected from the group consisting of: a jumper flowline connector; downstream of a jumper flowline or a section of a jumper flowline; a Christmas tree; a subsea collection manifold system; subsea Pipe Line End Manifold (PLEM); a subsea Pipe Line End Termination (PLET); and a subsea Flow Line End Termination (FLET).

In embodiments of the invention, the apparatus is configured to provide access to the production bore or the annulus of Christmas tree directly (i.e. without relying on access through the production wing or annulus wing). In one such implementation, the apparatus comprises a tree cap hub, and the first connector connects the body to a production bore of a Christmas tree. Preferably, the intervention apparatus comprises a fluid injection apparatus.

The tree cap hub may comprise an axial bore extending from an opening to the production bore to a top opening of the tree cap hub. The apparatus may be provided with a pressure cap, which may seal the top opening. The apparatus may comprise a debris cap and/or insulation cap. Conveniently, the apparatus may be deployed and left in situ on the subsea Christmas tree.

Alternatively, the apparatus may comprise a tree mandrel hub, and the first connector is configured to be connected to an annulus bore of a Christmas tree. The tree mandrel hub may comprise a bore extending from an opening to the annulus bore to a top opening of the tree mandrel hub. The bore may comprise a first axial portion extending from the opening to the annulus bore, a second axial portion extending from the top opening, and a radial portion joining the first and second axial portions. The apparatus may be provided with a pressure cap, which may seal the top opening. The apparatus may comprise a debris cap and/or insulation cap. Conveniently, the apparatus may be deployed for a subsea intervention operation or series of operations and recovered to surface. Preferably, the intervention apparatus comprises a fluid injection apparatus.

According to a second aspect of the invention, there is provided a subsea oil and gas production system comprising:

a subsea well and a subsea flow system in communication with the well; and an access hub;

wherein the access hub comprises a first connector connected to the subsea flow system;

a second connector configured to be connected to an intervention apparatus; and wherein a conduit between the first and second connectors provides an intervention path from the intervention apparatus to the subsea flow system.

The access hub may be connected to the flow system at a location selected from the group consisting of: a jumper flowline connector; downstream of a jumper flowline or a section of a jumper flowline; a Christmas tree; a subsea collection manifold system; a subsea Pipe Line End Manifold (PLEM); a subsea Pipe Line End Termination (PLET); and a subsea Flow Line End Termination (FLET).

Where the flow system comprises a subsea Christmas tree, the external opening may be downstream of a wing valve of the Christmas tree.

The external opening may be a flowline connector, such as a flowline connector for a jumper flowline. The apparatus may comprise a third connector for connecting the apparatus to a downstream flowline such as a jumper flowline. Therefore the apparatus may be disposed between a flowline connector and a jumper flowline, and may provide a flow path from the flow system to the jumper flowline, and may also establish an access point to the flow system, via the conduit and the first connector.

Embodiments of the second aspect of the invention may include one or more features of the first aspect of the invention or its embodiments, or vice versa.

According to a third aspect of the invention there is provided a method of performing a subsea intervention operation, the method comprising:

providing a subsea well and a subsea flow system in communication with the well;

providing an access hub on the subsea flow system, the access hub comprising a first connector connected to the subsea flow system and a second connector for an intervention apparatus;

connecting an intervention apparatus to the second connector;

accessing the subsea flow system via an intervention path though a conduit between the first and second connectors.

Preferably the access hub is pre-installed on the subsea flow system and left in situ at a subsea location for later performance of a subsea intervention operation. The intervention apparatus may then be connected to the pre-installed access hub and the method performed.

Preferably the method is a method of performing a fluid intervention operation. The method may comprise fluid sampling, fluid diversion, fluid recovery, fluid injection, fluid circulation, fluid measurement and/or fluid metering.

The method may be a method of performing a well scale squeeze operation.

The method may comprise performing a well fluid sampling operation. A preferred embodiment of the invention comprises: (a) performing a fluid injection operation; and (b) performing a well fluid sampling operation. Preferably the fluid injection operation and the well fluid sampling operation are both carried out by accessing the subsea flow system via the intervention path of the access hub.

Embodiments of the third aspect of the invention may include one or more features of the first or second aspects of the invention or their embodiments, or vice versa.

According to a fourth aspect of the invention there is provided an access hub for a flow system in a subsea oil and gas production system, the access hub comprising:

a body defining a conduit therethrough;

a first connector for connecting the body to a jumper flowline connector of the flow system;

a second connector for connecting the body to an intervention apparatus;

and a third connector for connecting the apparatus to a jumper flowline;

wherein, in use, the conduit provides an intervention path from the intervention apparatus to the flow system.

Preferably, the subsea flow system comprises a Christmas tree, and the jumper flowline connector is production wing flowline connector of the Christmas tree.

Embodiments of the fourth aspect of the invention may include one or more features of the first to third aspects of the invention or their embodiments, or vice versa.

According to a fifth aspect of the invention there is provided a subsea oil and gas production system comprising:

a subsea well; a subsea Christmas tree in communication with the well; a jumper flowline and an access hub;

wherein the access hub comprises a first connecter connected to a flowline connector of the Christmas tree, a second connector for connecting the body to an intervention apparatus, and a third connector connected to the jumper flowline; and wherein a a conduit between the first and second connectors provides an intervention path from the intervention apparatus to a production bore of the subsea Christmas tree.

Embodiments of the fifth aspect of the invention may include one or more features of the first to fourth aspects of the invention or their embodiments, or vice versa.

According to a sixth aspect of the invention there is provided an access hub for a subsea Christmas tree, the access hub comprising:

a tree cap comprising a tree cap connector configured to be connected to a production bore of the subsea Christmas tree and an upper connector for connecting the tree cap to an intervention apparatus;

wherein, in use, a conduit between the tree cap connector and the upper connector provides an intervention path from an intervention apparatus to the production bore of the subsea Christmas tree.

Preferably, the tree cap comprises a pressure cap. The tree cap may therefore be pre-installed on the Christmas tree and left in situ at a subsea location for later performance of a subsea intervention operation.

Embodiments of the sixth aspect of the invention may include one or more features of the first to fifth aspects of the invention or their embodiments, or vice versa.

According to a seventh aspect of the invention, there is provided a subsea oil and gas production system comprising:

a subsea well; a subsea Christmas tree in communication with the well; and an access hub;

wherein the access hub comprises a tree cap having a tree cap connector connected to production bore of the subsea Christmas tree and an upper connector configured to be connected to an intervention apparatus;

and wherein a conduit between the tree cap connector and the upper connector provides an intervention path from an intervention apparatus to a production bore of the subsea Christmas tree.

Embodiments of the seventh aspect of the invention may include one or more features of the first to sixth aspects of the invention or their embodiments, or vice versa.

According to an eighth aspect of the invention there is provided an access hub for a subsea Christmas tree, the access hub comprising:

a mandrel cap comprising a mandrel cap connector configured to be connected to an annulus bore of the subsea Christmas tree and an upper connector for connecting the mandrel cap to an intervention apparatus;

wherein, in use, a conduit between the mandrel cap connector and the upper connector provides an intervention path from an intervention apparatus to the annulus bore of the subsea Christmas tree.

Embodiments of the eighth aspect of the invention may include one or more features of the first to seventh aspects of the invention or their embodiments, or vice versa.

According to a ninth aspect of the invention, there is provided a subsea oil and gas production system comprising:

a subsea well; a subsea Christmas tree in communication with the well; and an access hub;

wherein the access hub comprises a mandrel cap having a mandrel cap connector connected to an annulus bore of the subsea Christmas tree, and an upper connector configured to be connected to an intervention apparatus;

and wherein a conduit between the mandrel cap connector and the upper connector provides an intervention path from an intervention apparatus to an annulus bore of the subsea Christmas tree.

Preferably, the tree comprises one or more pressure barriers and may comprise a dust and/or debris cap. The mandrel cap is preferably deployed for a particular subsea intervention operation or series of operations and recovered to surface, although it may alternative be pre-installed on the Christmas tree and left in situ at a subsea location for later performance of a subsea intervention operation.

Embodiments of the ninth aspect of the invention may include one or more features of the first to eighth aspects of the invention or their embodiments, or vice versa.

According to a tenth aspect of the invention there is provided a combined fluid injection and sampling apparatus for a subsea oil and gas production flow system, the apparatus comprising:

a body defining a conduit therethrough;

a first connector for connecting the body to the flow system;

a second connector for connecting the body to a fluid injection apparatus;

wherein, in use, the conduit provides an injection path from the intervention apparatus to the flow system;

and wherein the apparatus further comprises a sampling subsystem for collecting a fluid sample from the flow system.

Preferably the sampling chamber is in fluid communication with the flow system via the first connector.

The apparatus preferably comprises a third connector for connecting the apparatus to a downstream flowline such as a jumper flowline. Therefore the apparatus may be disposed between a flowline connector and a jumper flowline, and may provide a flow path from the flow system to the jumper flowline, and may also establish an access point to the flow system, via the conduit and the first connector.

The second connector may comprise a hose connector. The apparatus may comprise a hose connection valve, which may function to shut off and/or regulate flow from a connected hose through the apparatus. The hose connection valve may comprise a choke, which may be adjusted by an ROV (for example to regulate and/or shut off injection flow).

Preferably the apparatus comprises an isolation valve between the first connector and the second connector. The isolation valve preferably has a failsafe close condition, and may comprise a ball valve or a gate valve. The apparatus may comprise a plurality of isolation valves.

The sampling subsystem may comprise an end effector, which may be configured to divert flow to a sampling chamber of the sampling subsystem of the apparatus, for example by creating a hydrodynamic pressure.

An inlet to the sampling chamber may be fluidly connected to the first connector. An outlet to the sampling chamber may provide a fluid path for circulation of fluid through the chamber and/or exit to a flowline.

Preferably, the sampling subsystem comprises a sampling port, and may further comprise one or more sampling needle valves. The sampling subsystem may be configured for use with a sampling hot stab.

The sampling subsystem may be in fluid communication with the flow system via a flow path extending between the first and third connectors. Alternatively or in addition the sampling subsystem may be in fluid communication with the flow system via a flow path extending between the first and second connectors.

Alternatively or in addition the sampling subsystem may be in fluid communication with the flow system via at least a portion of an injection bore.

Embodiments of the tenth aspect of the invention may include one or more features of the first to ninth aspects of the invention or their embodiments, or vice versa. In particular, apparatus or systems of the first to ninth aspects of the invention may be configured with a sampling subsystem as described (to be used with in a sampling operation) and/or an injection flow path (for use in an injection operation), and the apparatus or systems of the first to ninth aspects of the invention may be configured for just one of sampling or injection.

According to an eleventh aspect of the invention there is provided a subsea oil and gas production system comprising:

a subsea well; a subsea Christmas tree in communication with the well; and a combined fluid injection and sampling unit;

wherein the a combined fluid injection and sampling unit comprises a first connector connected to the flow system and a second connector for connecting the body to an intervention apparatus;

wherein, in use, the conduit provides an injection path from an injection apparatus to the flow system;

and wherein the apparatus further comprises a sampling subsystem for collecting a fluid sample from the flow system.

The system may further comprise an injection hose, which may be connected to the combined fluid injection and sampling unit. The hose may comprise an upper hose section and a subsea hose section. The upper and subsea hose sections may be joined by a weak link connector. The weak link connector may comprise a first condition, in which the connection between the upper hose and the subsea hose is locked, and a second (operable) condition, in which the upper hose is releasable from the subsea hose.

Embodiments of the eleventh aspect of the invention may include one or more features of the first to tenth aspects of the invention or their embodiments, or vice versa.

According to a twelfth aspect of the invention there is provided a method of performing a subsea intervention operation, the method comprising:

providing a subsea well and a subsea flow system in communication with the well;

providing a combined fluid injection and sampling apparatus on the subsea flow system, the combined fluid injection and sampling apparatus comprising a first connector for connecting the apparatus to the flow system and a second connector for connecting the apparatus to a fluid injection apparatus;

connecting an injection hose to the second connector;

accessing the subsea flow system via an injection bore between the first and second connectors.

Preferably the combined fluid injection and sampling apparatus is pre-installed on the subsea flow system and left in situ at a subsea location for later performance of a subsea intervention operation. The injection hose may then be connected to the pre-installed unit and the method performed.

Preferably the method is a method of performing a fluid intervention operation. The method may comprise fluid sampling, fluid diversion, fluid recovery, fluid injection, fluid circulation, fluid measurement and/or fluid metering.

The method may be a method of performing a well scale squeeze operation.

The method may comprise performing a well fluid sampling operation. A preferred embodiment of the invention comprises: (a) performing a fluid injection operation; and (b) performing a well fluid sampling operation. Preferably the fluid injection operation and the well fluid sampling operation are both carried out by accessing the subsea flow system via the intervention path of the access hub.

Embodiments of the twelfth aspect of the invention may include one or more features of the first to eleventh aspects of the invention or their embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
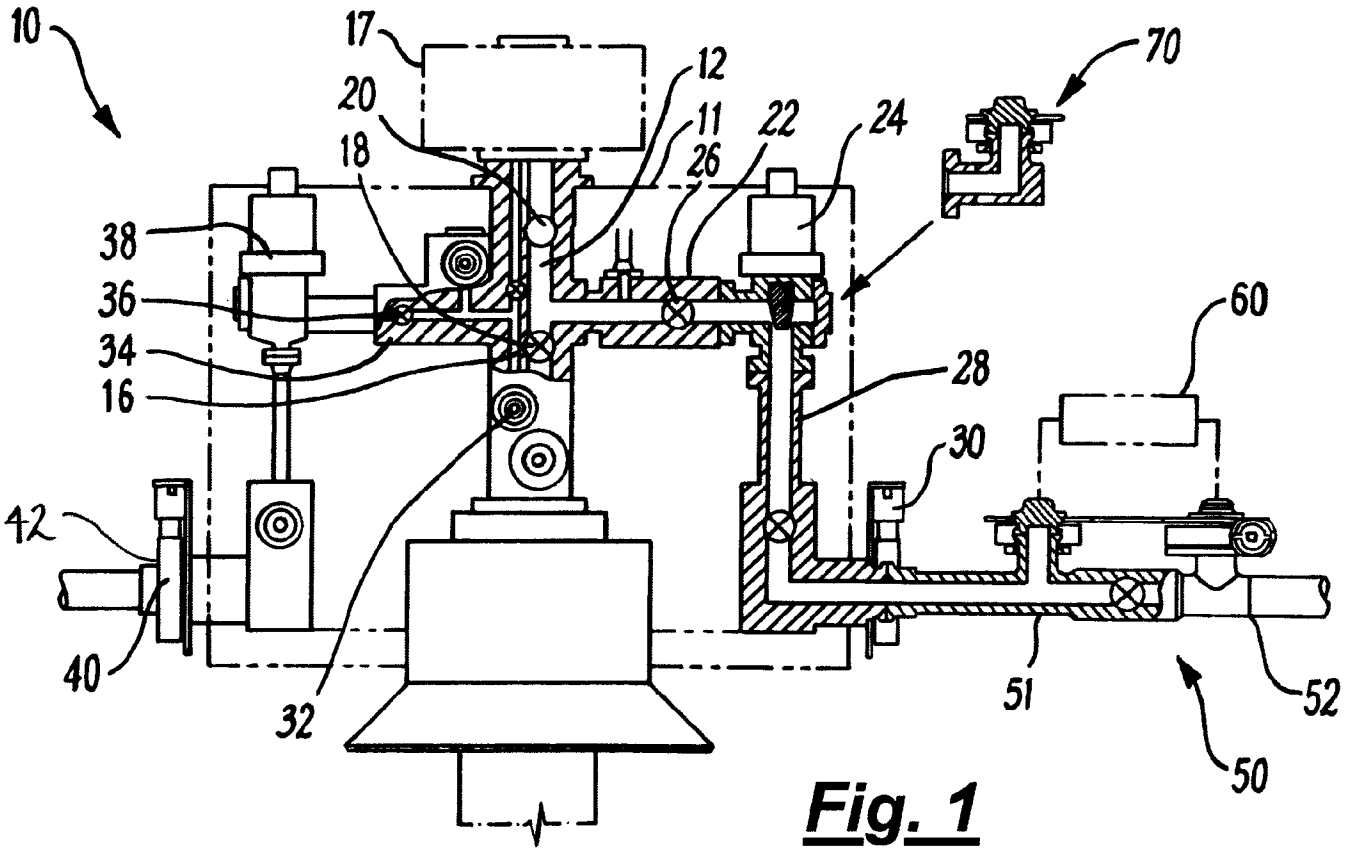
FIG. 1 is a part-sectional view of a subsea production system according to a first embodiment of the invention.

Referring firstly to FIG. 1, there is shown a production system generally depicted at 10, incorporating a subsea manifold in the form of a conventional vertical dual bore Christmas tree 11 located on a wellhead (not shown). The system 10 is shown in production mode, in a part-sectional view to show some external components from a side elevation and some parts of the system in longitudinal section. The tree 11 comprises a production bore 12 in communication with production tubing (not shown) and an annulus bore 16 in communication with the annulus between the casing and the production tubing. The upper part of the system 10 is closed by a conventional tree cap 17.

The production bore 12 comprises hydraulically controlled valves which include a production master valve 18 and a production swab valve 20 (as is typical for a vertical subsea tree). The production bore 12 also comprises a branch 22 which in includes production choke valve 24, and which may be closed from the bore 12 via production wing valve 26. The production branch 22 also includes an outlet conduit 28 leading to a flowline connector 30, which in this case is an ROV clamp, but may be any industry standard design including but not limited to ROV clamps, collet connectors, or bolted flanges. In this example the flowline connector 30 is horizontally oriented, and would conventionally be used for connection of a horizontally or vertically deployed jumper flowline.

On the annulus side, the annulus bore 16 comprises an annulus master valve 32 located below an annulus branch 34, which includes an annulus wing valve 36 which isolates the annulus branch 34 and annulus choke valve 38 from the bore 16. An annulus outlet conduit 40 leads to a flowline connector 42 (which as above may be any industry standard design).

Figure 2:
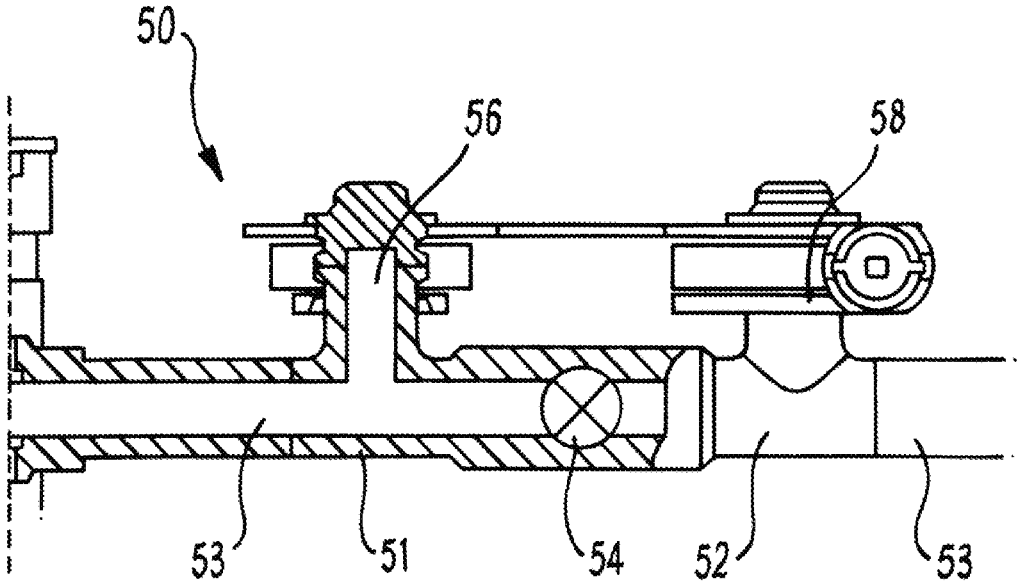
FIG. 2 is an enlarged sectional view of an alternative hub of the embodiment of FIG. 1.

The production system 10 is provided with a flow jumper hub assembly, generally shown at 50, and process equipment 60. An enlarged sectional view of the flow jumper hub assembly 50 is provided at FIG. 2. The assembly 50 includes a first jumper hub 51 connected into the flowline connector 30 of the production branch 22, and a second jumper hub 52 connected to the first jumper hub 51. The first jumper hub 51 defines a main flowline bore 53 and includes a valve 54 located after opening 56. The second hub 52 continues the main flowline bore 53 for connection into the primary production flowline (not shown) and includes opening 58. The openings 56 and 58 provide access points to the production system for a range of fluid intervention operations. These might include (but are not limited to) fluid sampling, fluid diversion, fluid recovery, fluid injection, fluid circulation, fluid measurement and/or fluid metering. In this case, when the valve 54 is closed, the opening 56 of the first hub 51 provides an outlet for fluid to flow from the production flowline to the processing equipment 60, and the opening 58 of the second hub 52 provides an inlet for re-entry of the processed fluid from the process equipment 60 to the production flowline.

By providing intervention access points in the flowline jumper, a number of advantages are realised compared with the prior art proposals which rely on access via choke bodies on the tree. Firstly, the production choke valve 24 remains in its originally intended position and therefore may be accessed and controlled using conventional techniques. Secondly, the flowline jumper hub assembly 50 may be engineered to support dynamic and/or static loads imparted by a wide range of fluid intervention equipment and processes, and is not subject to the inherent design limitations of the choke body of the tree. Thirdly, while there are spatial limitations around the choke body of the tree, the flowline jumper hub assembly may be located in a position which allows larger items and/or different configurations of process equipment to be positioned, and may also provide improved access of ROVs and/or divers to the process equipment or other components of the tree (such as the choke). In addition, the described configuration has application to a wide-range of production manifolds, including those which do not have integrated choke bodies (as is the case for example with some designs of subsea tree).

Figure 3:
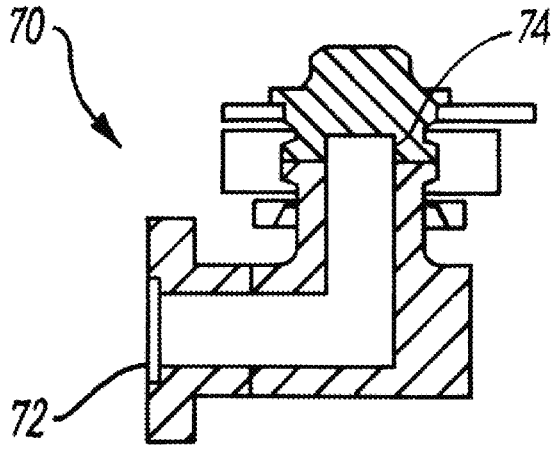
FIG. 3 is an enlarged sectional view of a jumper hub assembly of the embodiment of FIG. 1.

The system 10 FIG. 1 also shows an alternative hub, depicted generally at 70, which may be used as an alternative or in addition to the flowline jumper hub assembly 50 in alternative embodiments of the invention. An enlarged sectional view of the hub 70 is shown in FIG. 3. The hub 70 includes an inlet 72 for connection to a flow-block or pipe of a production manifold, and an outlet 74 (shown capped in FIGS. 1 and 3) configured to be connected to process equipment (such as for a fluid intervention operation as described above). In this embodiment, the hub 70 is configured to be mounted on the choke valve body (without removal of the choke valve itself). This means that is able to function as an access point for fluid intervention without interfering with the position and/or functionality of the production choke. In this embodiment, the inlet 72 and the outlet 74 are perpendicularly oriented to provide vertical access to a horizontal connection point in the manifold (or vice versa). Other configurations may of course be used in alternative embodiments of the invention.

The hub 70 may be used in combination with another access hub described herein, for example the hub assembly 50. In this latter case, the hub 70 may provide an inlet to process equipment for a fluid intervention operation and one of the openings of the hub 50 (conveniently the opening 58 which is downstream of the valve 54) may provide an inlet for re-entry of the processed fluid from the process equipment to the production flowline.

Although the hub assembly 50 and the hub 70 are described above with the context of a production system, and are shown to provide access points for the production wing of the tree, it will be appreciated that the hubs 50 and 70 may also be used in other modes and in particular can be connected to the annulus wing, for example to provide similar functionality in an injection process. The same applies to other embodiments of the invention unless the context specifically requires otherwise. Although the hub 70 is shown connected to an external opening of a choke body, other locations on the flow system may be used to provide access to the flow system via the hub. For example, the hub may be configured to be connected to any flange point in the flow system, the removal a blind flange providing a flange connection point for the hub 70. In particular the hub may be connected via any external opening may be downstream of a wing valve of the Christmas tree.

Figure 4:
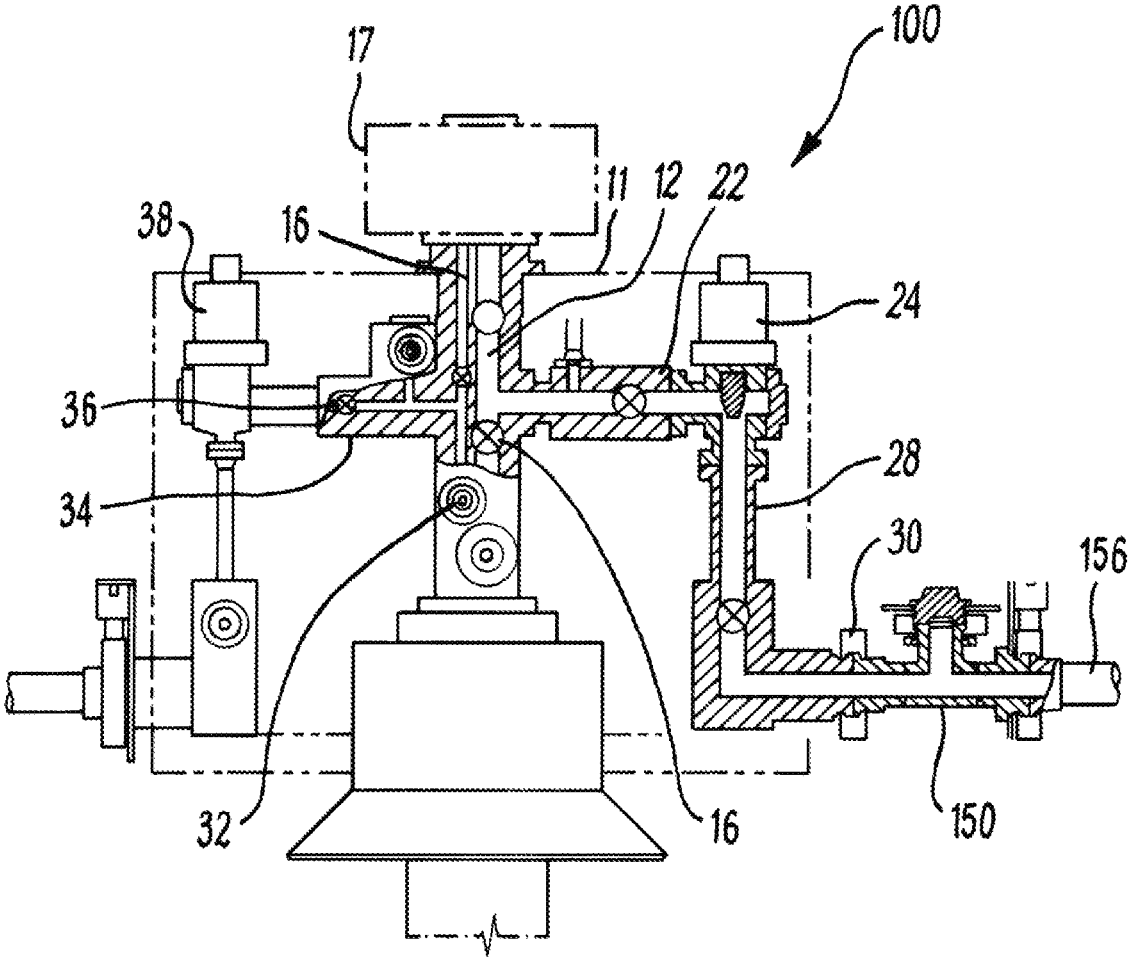
FIG. 4 is a part-sectional view of a subsea production system according to an alternative embodiment of the invention.

Referring now to FIG. 4, there is shown a production system according to an alternative embodiment of the invention, generally depicted at 100, incorporating a subsea manifold 11 which is the same as the conventional vertical dual bore Christmas tree of FIG. 1. Like components are indicated by like reference numerals. The system 100 is shown in production mode, in a part-sectional view to show some external components from a side elevation and some parts of the system in longitudinal-section.

Figure 5:
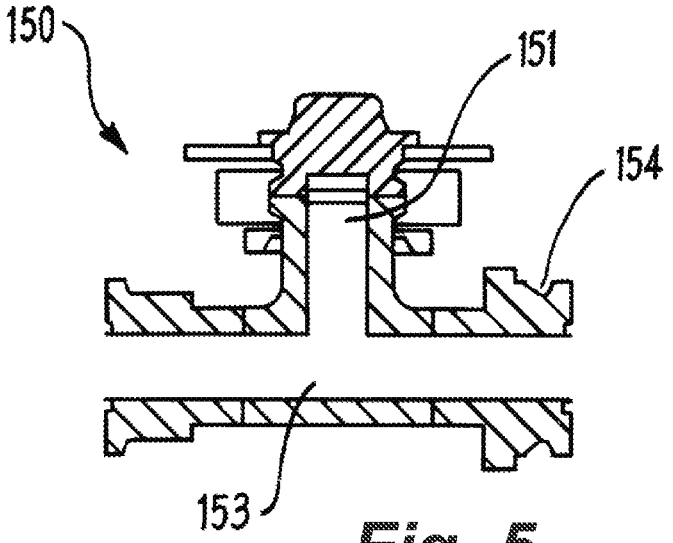
FIG. 5 is an enlarged sectional view of an alternative jumper hub, as used in the embodiment of FIG. 4.

The system 100 differs from the system 10 in that it is provided with an alternative jumper hub 150, which comprises a single hub opening 151 on a main flowline bore 153. An enlarged view of the jumper hub 150 is shown in FIG. 5. The jumper hub 150 is connected to the flowline connector 30 of the production branch outlet conduit 28, and at its opposing end has a standard flowline connector 154 for coupling to a conventional jumper 156. The embodiment of FIGS. 4 and 5 provide similar benefits to the embodiment of FIGS. 1 and 2, albeit with a single access point to the system 100. The hub 150 is relatively compact and robust and offers the additional advantage that it may be connected to the tree at surface (prior to its deployment subsea) more readily than larger hub assemblies.

The hub 150 may be used in combination with another access hub described herein, for example the hub assembly 50 or the hub 70. In the latter case, the hub 70 may provide an inlet to process equipment for a fluid intervention operation and the hub 150 may provide an inlet for re-entry of the processed fluid from the process equipment to the production flowline.

Figure 6:
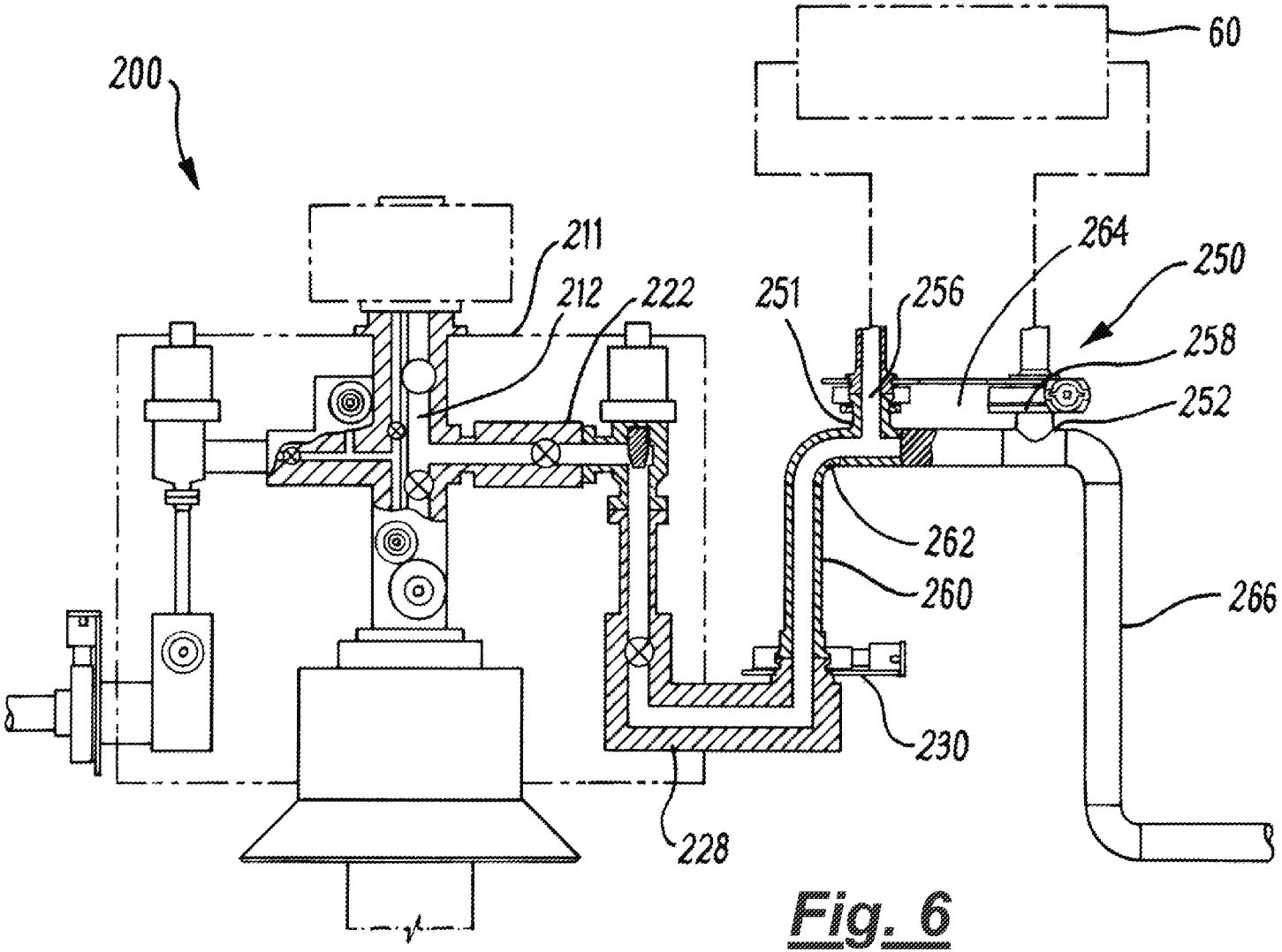
FIG. 6 is a sectional view of a subsea production tree system according to an alternative embodiment of the invention, including an alternative jumper hub assembly.

Referring now to FIG. 6, there is shown a production system according to a further alternative embodiment of the invention, generally depicted at 200, incorporating a subsea manifold in the form of a tree 211 which is similar to the conventional vertical dual bore Christmas tree 11 of FIG. 1. Like components are indicated by like reference numerals incremented by 200. The system 200 is also shown in production mode, in a part-sectional view to show some external components from a side elevation and some parts of the system in longitudinal-section.

The system 200 differs from the systems 10 and 100 in the nature of the jumper hub assembly 250 and its connection to the tree 211. In this case the hub assembly 250 comprises a first hub 251 connected to a vertically-oriented flowline connector 230 on the production outlet conduit 228, and a second jumper hub 252 connected to the first jumper hub 251. Each hub 251, 252 comprises an opening (256, 258 respectively) for facilitating access to process equipment 60, and functions in a similar manner to the hub assembly 50 of system 10. In this case, the hub 251 does not include a valve, and instead directs all of the fluid to the outlet and into the process equipment 60. However, in this embodiment the first jumper hub 251 comprises a vertically-oriented spool piece 260 with a perpendicular bend 262 into a horizontal section 264 on which the openings 256, 258 are located. The second hub 252 is connected to a vertically oriented 'U' spool jumper flowline 266. This embodiment provides a convenient horizontal section for access to the production flow for fluid intervention in a vertical 'U' spool configuration.

Figure 7:
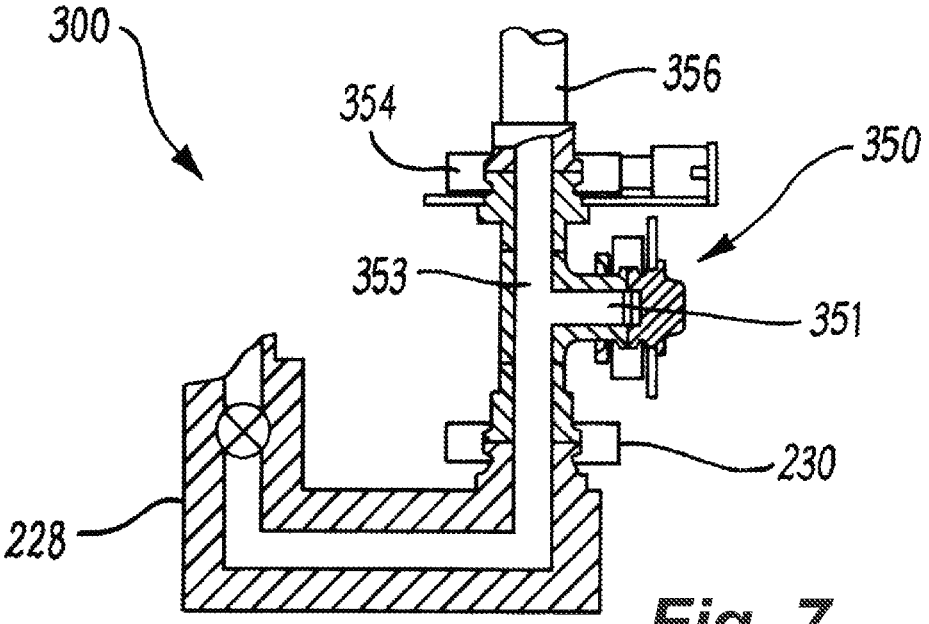
FIG. 7 is a sectional view of an alternative jumper hub spool piece that may be used with the embodiment of FIG. 6.

Referring now to FIG. 7, there is shown a detail of an alternative configuration 300 according to an embodiment of the invention, which includes a simple jumper hub 350 analogous to the hub 150 used with the production system 100. Hub 350 comprises a single hub opening 351 on a main flowline bore 353, and is connected to the flowline connector 230 of the production branch outlet conduit of the tree 211. At its opposing end has a standard flowline connector 354 for coupling to a vertically oriented 'U' spool jumper 356. The embodiment of FIG. 7 provides similar benefits to the embodiment of FIGS. 4 and 5, albeit with a single access point to the system. The hub 350 is relatively compact and robust compared to the hub assembly 250 and facilitates connection to the tree at surface (prior to its deployment subsea).

The hub 350 may be used in combination with another access hub described herein, for example the hub assembly 50 or the hub 70. In the latter case, the hub 70 may provide an inlet to process equipment for a fluid intervention operation and the hub 350 may provide an inlet for re-entry of the processed fluid from the process equipment to the production flowline. Alternatively or in addition, the configuration 300 may be modified to include a double hub assembly similar to the hub 50 in place of the hub 350, which may or may not include a valve in the main flowline bore.

The above-described embodiments provide a number of configurations for accessing a flow system in an oil and gas production system, which are flexible and suitable for use with and/or retrofitting to industry standard or proprietary oil and gas production manifolds. The invention extends to alternative configurations which provide access points through modified connections to the cap or mandrel of the tree, as described below.

Figure 8:
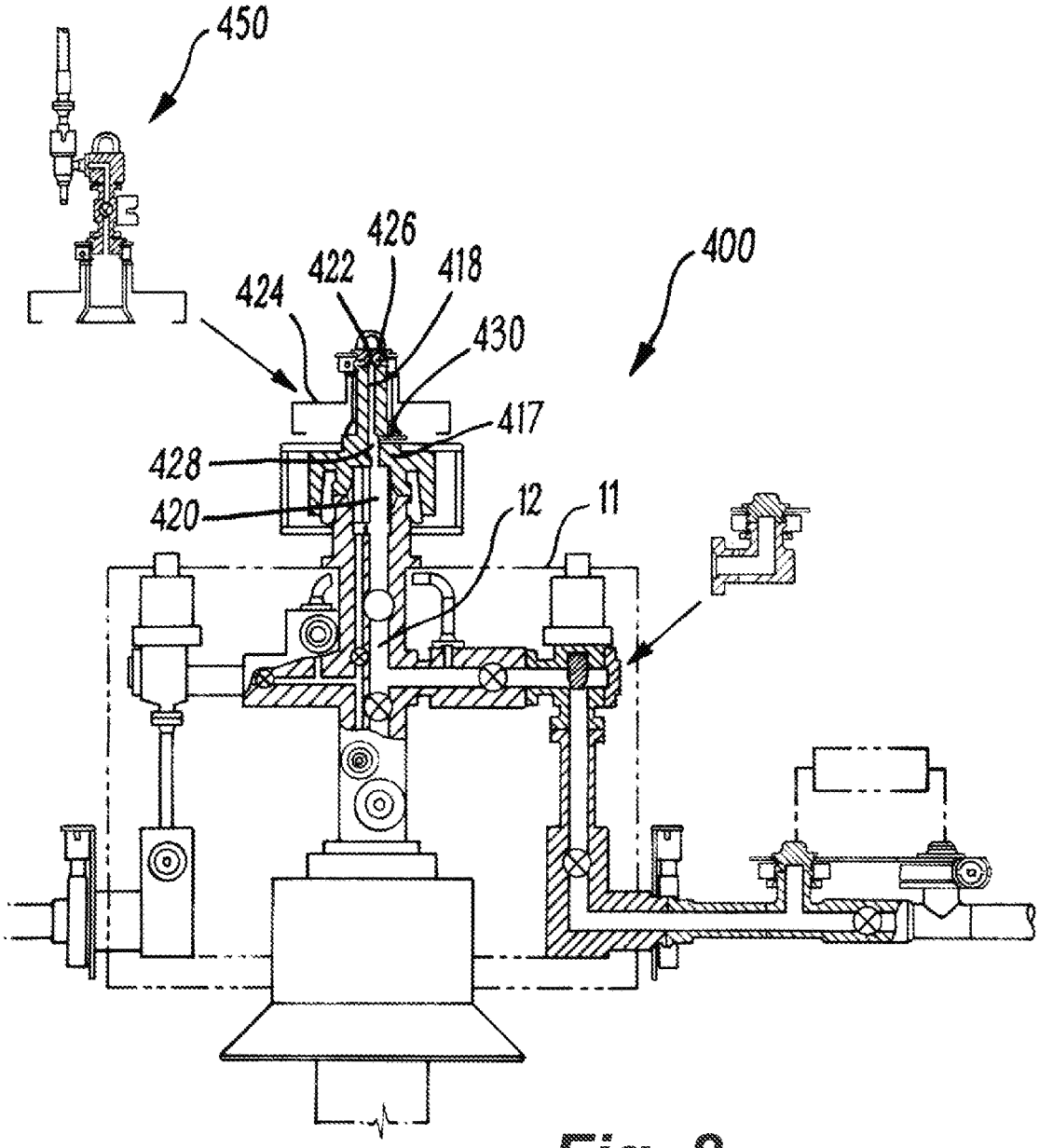
FIG. 8 is a sectional view of a subsea production tree system incorporating a modified tree cap according to an embodiment of the invention.

FIG. 8 shows a production system according to a further alternative embodiment of the invention, generally depicted at 400, incorporating a subsea manifold 11 which is a conventional vertical dual bore Christmas tree as shown in FIG. 1. Like components are indicated by like reference numerals incremented by 400. The system 400 is also shown in a part-sectional view to show some external components from a side elevation and some parts of the system in longitudinal-section.

In place of the conventional tree cap 17 used in the embodiments of FIGS. 1, 4, and 6, the system 400 comprises a tree cap hub (or modified tree cap) 417. The tree cap hub includes an axially (vertically) oriented pressure test line 418 which is in communication with the production bore 12 of the tree via a production seal sub 420. The pressure test line 418 extends axially through the tree cap to an opening 422 at the top of the cap. A debris cap 424 is placed over the tree cap 417 and includes a blind cap 426 to seal the opening 422. The blind cap 426 is removably fixed to the debris cap 424, in this case by an ROV style clamp.

A dog leg 428 in the pressure test line aligns the line concentrically with the cap (from the offset position of the production bore). The pressure test line 418 is an axial continuation of the production pressure test line 430 from the position at which it extends radially through the tree cap, right through the cap and up to the top of the cap. However, the inner diameter of the pressure test line is significantly greater compared with the bore size of the conventional pressure test line 430 to facilitate fluid intervention through the cap 417. Typical dimensions would be of the order of around 40 mm to 80 mm inner diameter, compared with around 6 mm inner diameter for a typical pressure test line (which is therefore not suitable for fluid intervention).

Figure 9:
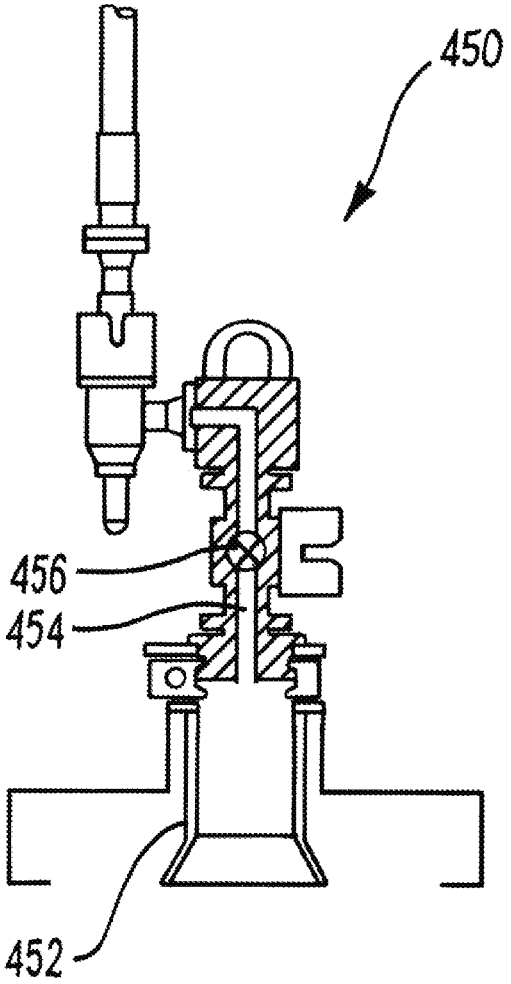
FIG. 9 is an enlarged sectional view of a tree cap injection hub according to an alternative embodiment of the invention, and which may be used with the embodiments of FIG. 8.

Also shown in FIG. 8, and in an enlarged view in FIG. 9, is a tree cap hub connector 450 for use with the modified tree cap 417 in the system 400. The tree cap hub connector 450 comprises a coupling 452 which allows it to be placed over the tree cap 417 after removal of the debris cap 424 and blind cap 426. The tree cap hub connector 450 has a bore 454 which is in fluid communication with the modified pressure test line 418. A valve 456 in the bore 454 allows controllable connection to process equipment, which may for example be a fluid injection system. In such a configuration, the tree cap hub 417 functions as an injection hub and provides a convenient access point for injection of fluids directly into the production bore of the tree, via the pressure test line 418, through the tree cap 417, and into the production bore 12 itself.

Significantly, the above-described tree cap hub 417 provides a convenient and flexible way of carrying out fluid interventions which does not rely on the removal of or interference with choke valves. In addition, the tree cap itself is typically able to withstand static and dynamic loading far in excess of the choke bodies, which facilitates mounting of large and massive process equipment associated with the fluid intervention operations onto the tree.

Figure 10:
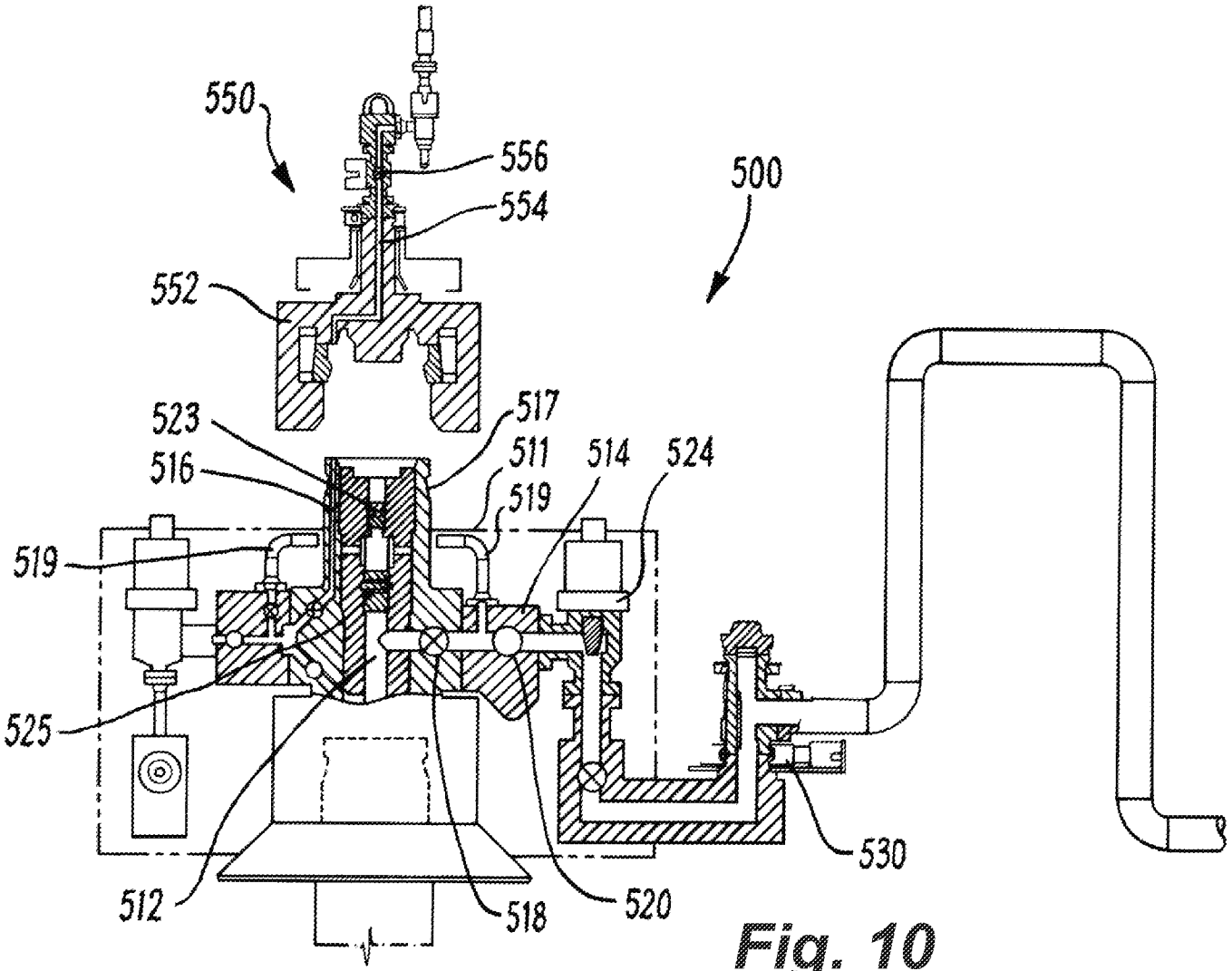
FIG. 10 is a part-sectional view of a horizontal style subsea production tree system according to an embodiment of the invention.

Referring now to FIG. 10, there is shown generally at 500 a subsea production system consisting of a horizontal-style Christmas tree 511 on a wellhead (not shown). The system 500 is shown in tree mandrel fluid injection mode, in a part-sectional view to show some external components from a side elevation and some parts of the system in longitudinal-section. The tree 511 comprises a production bore 512 in communication with production tubing (not shown). A production wing 514 incorporates the production master valve 518 and a production wing valve 520 oriented horizontally in the production wing 514, and a production choke valve 524 controls flow to a production outlet and vertically-oriented flowline connector 530.

An annulus bore 516 is in fluid communication with the production wing via a cross-over loop 519. The upper part of the tree 511 is closed by upper and lower plugs 523, 525 respectively.

Figure 11:
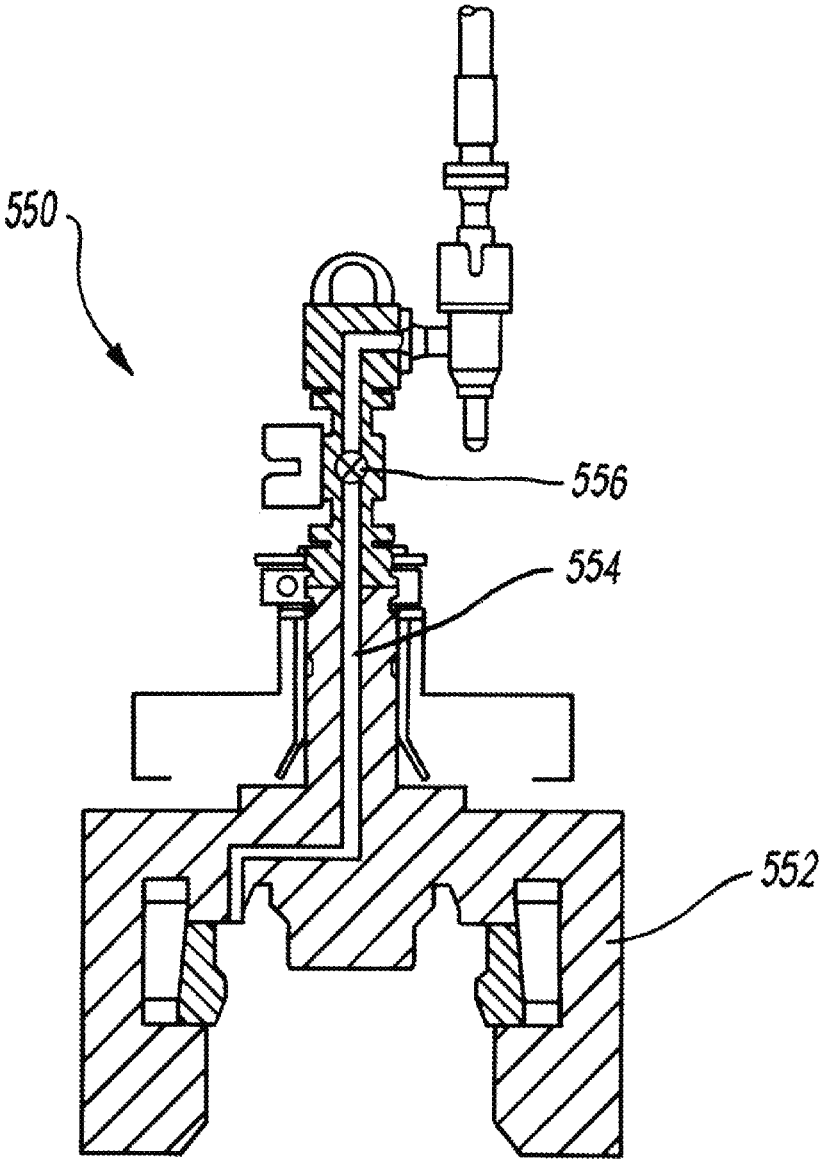
FIG. 11 is an enlarged sectional view of a tree cap injection hub used with a system of FIG. 10.

Also shown in FIG. 10, and in an enlarged view in FIG. 11, is a tree mandrel hub 550 for use with the system 500. The tree mandrel hub 550 comprises a mandrel connector hub 552 which allows it to be placed over the tree mandrel 517. The tree mandrel hub 550 has a bore 554 which is in fluid communication with annulus bore 516, and a valve 556 in the bore 554 allows controllable connection to process equipment such as a fluid injection system. In such a configuration, the tree mandrel hub 550 functions as an injection hub and provides a convenient access point for injection of fluids into the production bore of the tree, via the annulus bore 516, through the crossover loop 519, into the production wing 514, and into the production bore 512 itself.

The tree mandrel injection hub 550 provides another convenient means of performing fluid intervention, this time via the annulus of a horizontal style tree. This embodiment offers similar advantages to the embodiment of FIGS. 8 and 9 including minimal interference with the choke valves, flexibility of operation, and use of larger scale process equipment and/or application to wide range of subsea manifolds. It will be appreciated that the embodiments of FIGS. 8 to 11 may be used in production mode in addition to the fluid injection modes described above.

It will be appreciated that the present invention provides a hub for access to a subsea flow system that facilitates a wide range of different subsea operations. One example application to a combined injection and sampling hub will be described with reference to FIGS. 12 to 14.

Figure 12A:
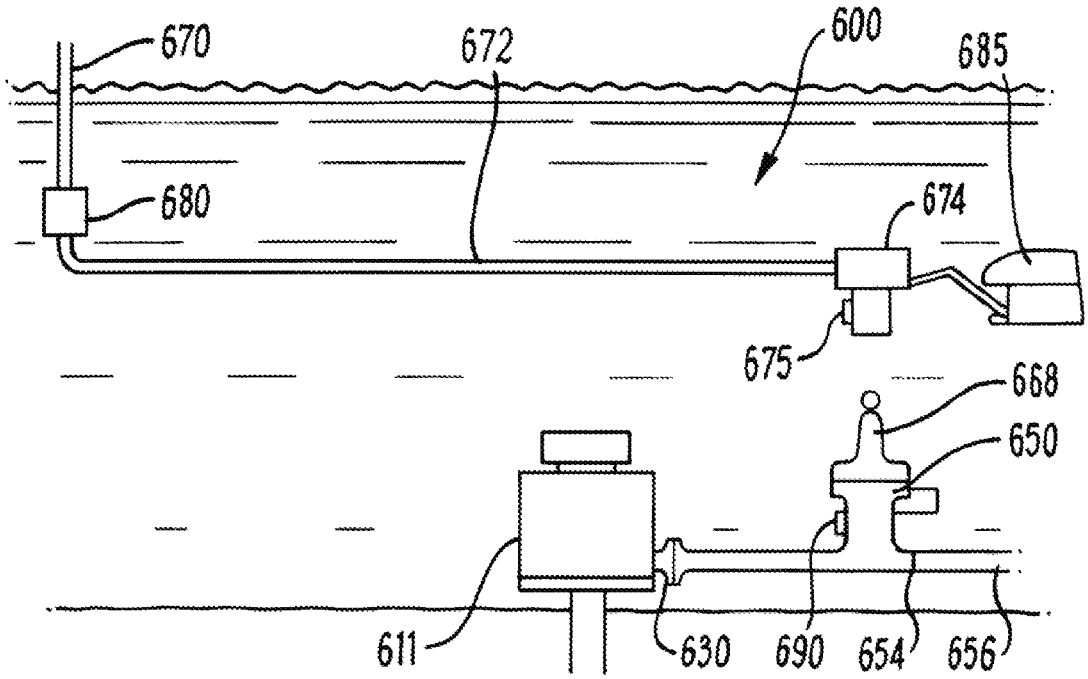
FIGS. 12A and 12B show schematically a subsea system used in successive stages of a well squeeze operation.
Figure 12B:
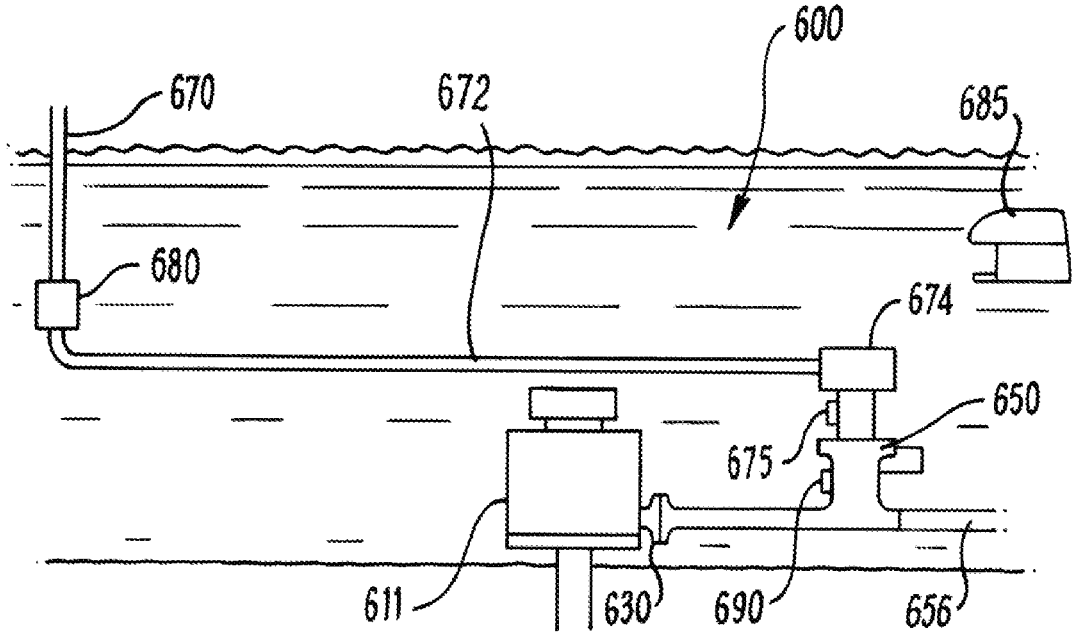

FIGS. 12A and 12B are schematic representations of a system, generally shown at 600, shown in different stages of a subsea injection operation in a well squeeze application. The system 600 comprises a subsea manifold 611, which is a conventional vertical dual bore Christmas tree, similar to that shown in FIG. 1 and FIG. 4. The subsea tree configuration utilises a hub 650 to provide access to the flow system, and is similar to the system shown in FIG. 4, with internal tree components omitted for simplicity. The flowline connector 630 of the production branch outlet conduit (not shown) is connected to the hub 650 which provides a single access point to the system. At its opposing end, the hub 650 comprises a standard flowline connector 654 for coupling to a conventional jumper 656. In FIG. 12A, the hub 650 is shown installed with a pressure cap 668. Optionally a debris and/or insulation cap (not shown) may also be provided on the pressure cap 668.

The system 600 also comprises an upper injection hose 670, deployed from a surface vessel (not shown). The upper injection hose 670 is coupled to a subsea injection hose 672 via a weak link umbilical coupling 680, which functions to protect the subsea equipment, including the subsea injection hose 672 and the equipment to which it is coupled from movement of the vessel or retrieval of the hose. The subsea injection hose 672 is terminated by a hose connection termination 674 which is configured to be coupled to the hub 650. The hub 650 is configured as a combined sampling and injection hub, and is shown in more detail in FIG. 14 (when connected to the hose connection 674 in the mode shown in FIG. 12B).

Figure 14:
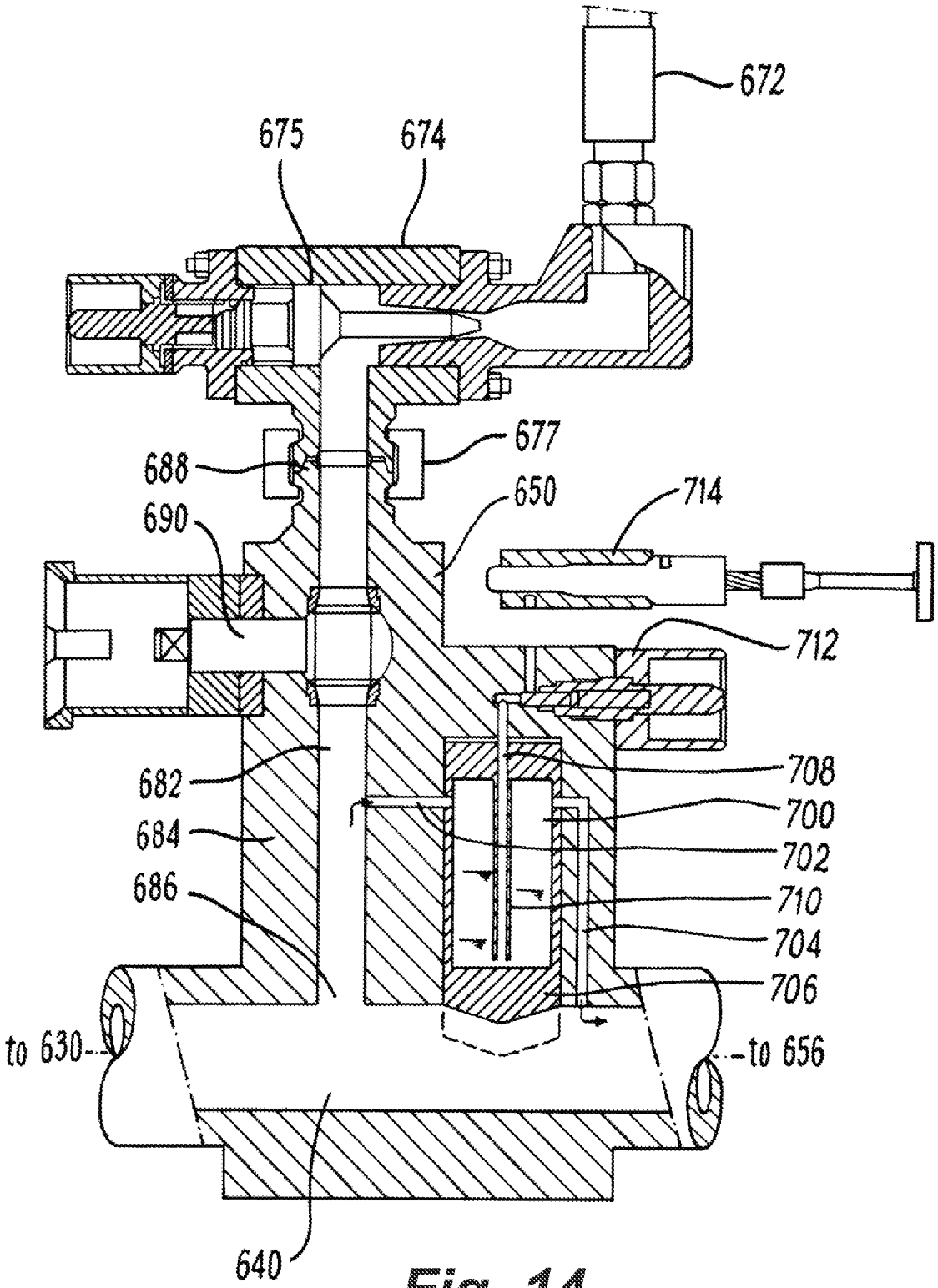
FIG. 14 is a sectional view of a combined injection and sampling hub used in the systems of FIGS. 12 and 13, when coupled to an injection hose connection.

As shown most clearly in FIG. 14, the hose connection termination 674 incorporates a hose connection valve 675, which functions to shut off and regulate injection flow. The hose connection valve 675 in this example is a manual choke valve, which is adjustable via an ROV to regulate injection flow from the hose 672, through the hose connection 674 and into the hub 650. The hose connection 674 is connected to the hub via an ROV style clamp 677 to a hose connection coupling 688.

The hub 650 comprises an injection bore 682 which extends through the hub body 684 between an opening 686 from the main production bore 640 and the hose connection coupling 688. Disposed between the opening 688 and the hose connection coupling 688 is an isolation valve 690 which functions to isolate the flow system from injection flow. In this example, a single isolation valve is provided, although alternative embodiments may include multiple isolation valves in series. The isolation valve 690 is a ball valve, although other valve types (including but not limited to gate valves) may be used in alternative embodiments of the invention. The valve 690 is designed to have a fail-safe closed condition (in embodiments with multiple valves at least one should have a fail-safe closed condition).

The hub 650 is also provided with a sampling chamber 700. The sampling chamber comprises an inlet 702 fluidly connected to the injection bore 682, and an outlet 704 which is in fluid communication with the main production bore 640 downstream of the opening 686. The sampling chamber 700 is provided with an end effector 706, which may be pushed down into the flow in the production bore 640 to create a hydrodynamic pressure which diverts flow into the injection bore 682 and into the sampling chamber 700 via the inlet 702. Fluid circulates back into the main production bore via the outlet 704.

In an alternative configuration the inlet 702 may be fluidly connected directly to the production bore 640, and the end effector 706 may cause the flow to be diverted into the chamber 700 directly from the bore 640 via the inlet.

The sampling chamber 700 also comprises a sampling port 708, which extends via a stem 710 into the volume defined by the sampling chamber. Access to the sampling port 708 is controlled by one or more sampling needle valves 712. The system is configured for use with a sampling hot stab 714 and receptacle which is operated by an ROV to transfer fluid from the sampling chamber into a production fluid sample bottle (as will be described below with reference to FIGS. 13A and 13B).

The operation of the system 600 in an application to a well squeeze operation will now be described, with reference to FIGS. 12A and 12B. The operation is conveniently performed using two independently operated ROV spreads, although it is also possible to perform the operation with a single ROV. In the preparatory steps a first ROV (not shown) inspects the hub 650 with the pressure cap 668 in place, in the condition as shown in FIG. 12A. Any debris or insulation caps (not shown) are detached from the hub 650 and recovered to surface by the ROV. The ROV is then used to inspect the system for damage or leaks and to check that the sealing hot stabs are in position. The ROV is also used to check that the tree and/or jumper isolation valves are closed. Pressure tests are performed on the system via the sealing hot stab (optionally a full pressure test is performed), and the cavity is vented. The pressure cap 668 is then removed to the ROV tool basket, and can be recovered to surface for inspection and servicing if required.

The injection hose assembly 670/672 is prepared by setting the weak link coupling 680 to a locked position and by adjusting any trim floats used to control its buoyancy. The hose connection valve 675 is shut off and the hose is pressure tested before setting the hose pressure to the required deployment value. A second ROV 685 is deployed below the vessel (not shown) and the hose is deployed overboard to the ROV. The ROV then flies the hose connection 674 to the hub 650, and the connection 674 is clamped onto the hub and pressure tested above the isolation valve 690 via an ROV hot stab. The weak link 680 is set to its unlocked position to allow it to release the hose 670 from the subsea hose 672 and the hub 650 in the event of movement of the vessel from its location or retrieval of the hose.

The tree isolation valve is opened, and the injection hose 672 is pressurised to the desired injection pressure. The hose connection valve 675 is opened to the desired setting, and the isolation valve is opened. Finally the production wing isolation valve is opened to allow injection flow from the hose 672 to the production bore to commence and the squeeze operation to be performed. On completion, the sequence is reversed to remove the hose connection 674 and replace the pressure cap 668 and any debris/insulation caps on the hub 650.

Figure 13A:
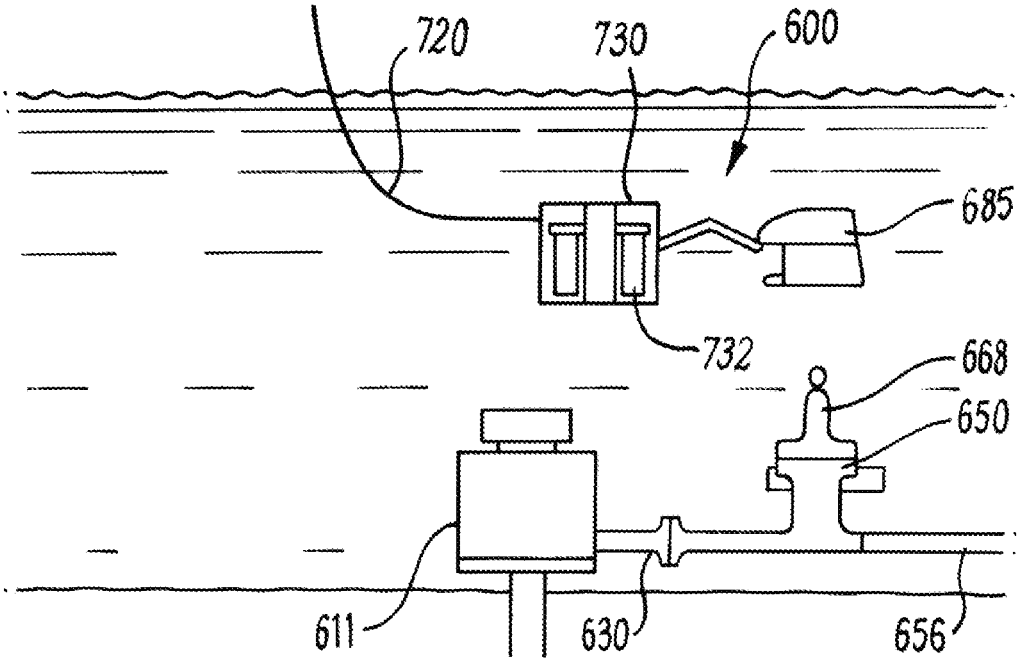
FIGS. 13A and 13B show schematically the subsea system used in successive stages of a production fluid sample operation.
Figure 13B:
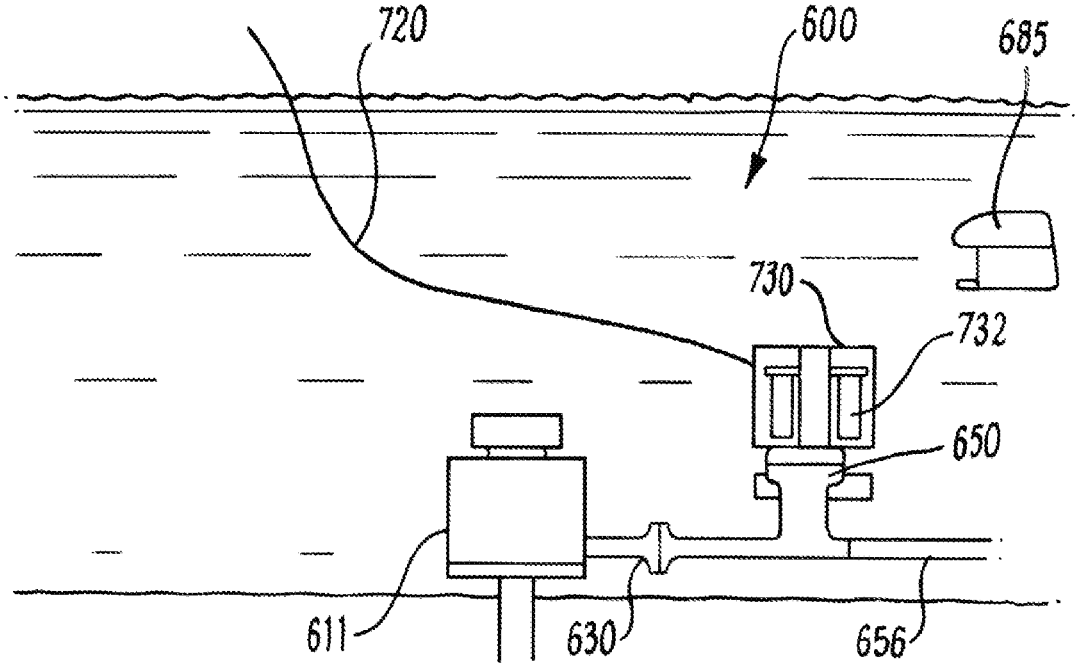

It is a feature of this aspect and embodiment of the invention that the hub 650 is a combined injection and sampling hub; i.e. the hub can be used in an injection mode (for example a well squeeze operation as described above) and in a sampling mode as described below with reference to FIGS. 13A and 13B.

The sampling operation may conveniently be performed using two independently operated ROV spreads, although it is also possible to perform this operation with a single ROV. In the preparatory steps, a first ROV (not shown) inspects the hub 650 with its pressure cap 668 in place (as shown in FIG. 13A). Any debris or insulation cap fitted to the hub 650 is detached and recovered to surface by a sampling Launch and Recovery System (LARS) 720. The ROV is used to inspect the system for damage or leaks, and to check that the sealing hot stabs are in position.

The sampling LARS 720 subsequently used to deploy a sampling carousel 730 from the vessel (not shown) to depth and a second ROV 685 flies the sampling carousel 730 to the hub location. The pressure cap 668 is configured as a mount for the sampling carousel 730. The sampling carousel is located on the pressure cap locator, and the ROV 685 indexes the carousel to access the first sampling bottle 732. The hot stab (not shown) of the sampling bottle is connected to the fluid sampling port 708 to allow the sampling chamber 700 to be evacuated to the sampling bottle 732. The procedure can be repeated for multiple bottles as desired or until the bottles are used.

On completion, the sample bottle carousel 730 is detached from the pressure cap 668 and the LARS 720 winch is used to recover the sample bottle carousel and the samples to surface. The debris/insulation cap is replaced on the pressure cap 668, and the hub is left in the condition shown in FIG. 13A.

The invention provides an apparatus and system for accessing a flow system (such as a subsea tree) in a subsea oil and gas production system, and method of use. The apparatus comprises a body defining a conduit therethrough and a first connector for connecting the body to the flow system. A second connector is configured for connecting the body to an intervention apparatus, such as an injection or sampling equipment. In use, the conduit provides an intervention path from the intervention apparatus to the flow system. Aspects of the invention relate to combined injection and sampling units, and have particular application to well scale squeeze operations.

Embodiments of the invention provide a range of hubs and/or hub assemblies which facilitate convenient intervention operations. These include fluid introduction for well scale squeeze operations, well kill, hydrate remediation, and/or hydrate/debris blockage removal; fluid removal for well fluid sampling and/or well fluid redirection; and/or the addition of instrumentation for monitoring pressure, temperature, flow rate, fluid composition, erosion and/or corrosion. Aspects of the invention facilitate injection and sampling through a combined unit which provides an injection access point and a sampling access point. Other applications are also within the scope of the invention.

It will be appreciated that the invention facilitates access to the flow system in a wide range of locations. These include locations at or on the tree, including on a tree or mandrel cap, adjacent the choke body, or immediately adjacent the tree between a flowline connector or a jumper. Alternatively the apparatus of the invention may be used in locations disposed further away from the tree. These include (but are not limited to) downstream of a jumper flowline or a section of a jumper flowline; a subsea collection manifold system; a subsea Pipe Line End Manifold (PLEM); a subsea Pipe Line End Termination (PLET); and/or a subsea Flow Line End Termination (FLET).

Various modifications may be made within the scope of the invention as herein intended, and embodiments of the invention may include combinations of features other than those expressly described herein.

What is claimed:

1. An access hub assembly for a flow system in a subsea oil and gas production system, the access hub assembly comprising:

a body defining a conduit therethrough;

a first connector for connecting the assembly to a flowline connector for a jumper of the flow system;

first and second conduits in the assembly;

and first and second openings in the assembly, the first and second openings providing access points to the flow system for an intervention apparatus via the first and second conduits;

wherein the access hub assembly is configured to be disposed between the flowline connector for a jumper flowline and a jumper flowline, such that it is in fluid communication with the jumper flowline;

and wherein, in use, the first conduit provides an intervention path from the intervention apparatus to the flow system via the flowline connector for a jumper flowline.

2. The access hub assembly according to claim 1, configured to support dynamic and/or static loads imparted by an intervention apparatus.

3. The access hub assembly according to claim 1, configured for connection to a subsea flow system comprising a subsea production manifold, wherein the flowline connector for a jumper flowline is a jumper flowline connector of the subsea production manifold.

4. A method of performing a subsea intervention operation, the method comprising:

providing a subsea well and a subsea flow system in communication with the well;

providing an access hub assembly according to claim 1 on the subsea flow system;

connecting an intervention apparatus to the first and/or second opening in the access hub assembly;

accessing the subsea flow system via an intervention path through the first conduit and/or the second conduit in the access hub assembly.

5. The method according to claim 4, comprising performing a fluid intervention operation selected from the group consisting of: fluid sampling, fluid diversion, fluid recovery, fluid injection, fluid circulation, fluid measurement and/or fluid metering.

6. The method according to claim 4, wherein the access hub assembly is pre-installed on the subsea flow system and left in situ at a subsea location for later performance of a subsea intervention operation.

7. The method according to claim 4, comprising connecting an intervention apparatus to the pre-installed access hub assembly and the performing the subsea intervention operation.

8. The method according to claim 4, comprising performing a fluid intervention operation.

9. The method according to claim 4, comprising performing a well scale squeeze operation.

10. The method according claim 4, comprising performing a well fluid sampling operation.

11. The method according to claim 4, comprising performing a fluid injection operation; and performing a well fluid sampling operation.

12. The method according to claim 11, wherein the fluid injection operation and the well fluid sampling operation are both carried out by accessing the subsea flow system via an intervention path of the access hub assembly.

13. The access hub assembly according to claim 1, wherein the assembly is configured for use in a fluid sampling, fluid diversion, fluid recovery, fluid injection, fluid circulation, fluid measurement and/or fluid metering operation.

14. The access hub assembly according to claim 1, wherein the flow system comprises a subsea Christmas tree, and the flowline connector for a jumper flowline is downstream of a wing valve of the Christmas tree.

15. The access hub assembly according to claim 1, configured for connection to a subsea flow system comprising a Christmas tree, wherein the flowline connector for a jumper flowline is a jumper flowline connector of the Christmas tree.

16. The access hub assembly according claim 1, wherein, in use, the second conduit provides an intervention path from the intervention apparatus to the flow system via the jumper flowline.

17. The access hub assembly according to claim 1, wherein, in use, the first opening provides an outlet for fluid to flow from the production system to the intervention apparatus.

18. The access hub assembly according to claim 1, wherein, in use, the first opening provides an inlet to the intervention apparatus for a fluid intervention operation.

19. The access hub assembly according to claim 1, wherein, in use, the second opening provides an inlet for re-entry of processed fluid from the intervention apparatus to the jumper flowline.

20. The access hub assembly according to claim 1, wherein the access hub assembly comprises a first access hub and a second access hub;

wherein the first access hub is configured to be connected to the flowline connector for a jumper flowline;

wherein the second access hub is configured to be connected to the jumper flowline of the flow system to allow fluid to flow from the second access hub to the jumper flowline;

wherein the first opening comprises a connector of the first access hub, providing an access point to the flow system via the first access hub; and and wherein the second opening comprises a connector of the second access hub, providing an access point to the jumper flowline via the second hub.

21. The access hub assembly according to claim 20, wherein the first opening of the first access hub provides an outlet for fluid to flow from the flow system to a processing equipment used in a fluid intervention operation and/or an inlet to the processing equipment for a fluid intervention operation, and the second opening of the second access hub provides an inlet for re-entry of a processed fluid from the process equipment to the production flowline.

22. A subsea oil and gas production system comprising:

a subsea well and a subsea flow system in communication with the well; and an access hub assembly according to claim 1;

wherein the subsea flow system comprises a flowline connector for a jumper flowline and a jumper flowline; and wherein the access hub assembly is disposed between the flowline connector for a jumper flowline and the jumper flowline such that it is in fluid communication with the jumper flowline; and wherein the first conduit of the access hub assembly provides an intervention path from the intervention apparatus to the flow system via the flowline connector for a jumper flowline.

23. The system according to claim 22, wherein the flow system comprises a subsea Christmas tree, and the access hub assembly is connected to an external opening of the flow system downstream of a wing valve of the Christmas tree.

24. The system according to claim 22, wherein the flow system comprises a subsea Christmas tree, and wherein the flowline connector for a jumper flowline is a jumper flowline connector of the Christmas tree.

25. The system according to claim 22, wherein the flow system comprises a subsea production manifold, and wherein the flowline connector for a jumper flowline is a jumper flowline connector of the subsea production manifold.

26. The system according to claim 22, wherein the access hub assembly comprises a first access hub and a second access hub;

wherein the first access hub is connected to the flowline connector for a jumper flowline;

wherein the second access hub is connected to the jumper flowline of the flow system to allow fluid to flow from the second access hub to the jumper flowline;

wherein the first opening comprises a connector of the first access hub, providing an access point to the flow system via the first access hub; and and wherein the second opening comprises a connector of the second access hub, providing an access point to the jumper flowline via the second hub.

27. The system according to claim 26, wherein the first opening of the first access hub provides an outlet for fluid to flow from the flow system to a processing equipment used in a fluid intervention operation and/or an inlet to the processing equipment for a fluid intervention operation, and the second opening of the second access hub provides an inlet for re-entry of a processed fluid from the process equipment to the production flowline.

* * * * *